US005097769A

United States Patent [19]

Raschbichler et al.

[11] Patent Number: 5,097,769

[45] Date of Patent: Mar. 24, 1992

[54] STRUCTURE FOR SUPPORTING TRACKWAY OF A TRACK FOLLOWING TRANSPORTATION SYSTEM, IN PARTICULAR, A MAGNETIC SUSPENSION RAILROAD

[75] Inventors: Hans G. Raschbichler; Luitpold Miller, both of Ottobrunn, Fed. Rep. of Germany

[73] Assignee: Thyssen Industrie A G, Essen, Fed. Rep. of Germany

[21] Appl. No.: 551,553

[22] Filed: Jul. 11, 1990

[30] Foreign Application Priority Data

Jul. 25, 1989 [DE] Fed. Rep. of Germany ..... 3924555
Aug. 26, 1989 [DE] Fed. Rep. of Germany ..... 3928278

[51] Int. Cl.[5] ..... E01B 25/10

[52] U.S. Cl. ..... 104/124; 104/89; 104/281; 248/317

[58] Field of Search ..... 104/111, 123, 124, 125, 104/89, 281; 248/317; 403/258, 262, 375, 315, 408.1

[56] References Cited

U.S. PATENT DOCUMENTS 732,389 11/1902 Wheater ..... 403/258
2,577,789 10/1944 McCarn ..... 104/111
4,694,531 9/1987 Foy ..... 104/111 X
4,698,895 10/1987 Miller et al. ..... 104/281
4,934,276 6/1990 Garpentin et al. ..... 104/111

FOREIGN PATENT DOCUMENTS 2918811 11/1980 Fed. Rep. of Germany .
3404061 6/1985 Fed. Rep. of Germany .
3412401 6/1985 Fed. Rep. of Germany .

OTHER PUBLICATIONS

Hilliges, Mölzer, Raschbichler, and Zurek Article in ZEV-Glas. Ann. 105, 1981 No. 7/8 pp. 205-215.

*Primary Examiner*—Robert J. Oberleitner
*Assistant Examiner*—Kevin D. Rutherford
*Attorney, Agent, or Firm*—Michael J. Striker

[57] ABSTRACT

A structure for supporting a trackway of a track following transportation system, particularly, a magnetic suspension railroad and including a support and at least one equipment element having an operational surface and attached to the support. The supporting structure further includes bolts for securing the equipment element to the support. There is further provided a form-locking means which becomes effective only if the fixing bolts fail and which then limits displacement of the equipment element relative to the support to a predetermined amount.

17 Claims, 8 Drawing Sheets

STRUCTURE FOR SUPPORTING TRACKWAY OF A TRACK FOLLOWING TRANSPORTATION SYSTEM, IN PARTICULAR, A MAGNETIC SUSPENSION RAILROAD

CROSS-REFERENCE TO RELATED APPLICATIONS

A copending application Ser. No. 07/551,564 has been filed.

BACKGROUND OF THE INVENTION

The invention relates to a structure for supporting a trackway of a track following transportation system, particularly, of a magnetic suspension railroad, comprising at least one support, at least one equipment element having an operational surface extending in a track direction, and means for securing the equipment element on the support and including fixing bolts. The invention also relates to a method of manufacturing such a supporting structure.

Trackways, in cement or steel version (ZEV-Glas. Ann. 105, 1981, No. 7/8, pages 205-215, U.S. Pat. No. 4,698,895) for track following transportation system comprise generally a plurality of supporting structures extending one behind the other along the track and on which are mounted all equipment elements necessary for operation of the system, in particular, for transporting, guiding, driving, braking, etc. of system cars. In a magnetic suspension railroad, for example, each supporting structure includes a bent-resistant support to which an equipment element in a form of lateral guide strips, reaction strips of an elongate stator of a motor are attached. At that, the support is supported by studs anchored in a foundation by any appropriate method.

To secure an equipment element to a support generally fixing bolts are used. The bolt extends through bores in the equipment element and respective thread bores in the support and with their head engaging the equipment element. At that, the fixing bolt should be stable to transmit to the support forces and torques transmitted to the equipment element by the car. To this end the axes of the fixing bolts generally extend transverse to operational surfaces of the equipment elements. The latter also serves for a proper positioning of the equipment elements or their operational surfaces relative to the support in accordance with the track course, i.e. the given line.

Securing of each equipment element to a corresponding support is effected preferably with two pairs of fixing bolts which form a redundant securing system. To avoid failure of the fixing bolts, the fixing bolts should have a very high quality, without manufacturing defects, and have dimensions corresponding to an expected load. In view of the large number of fixing elements required (more than thousand per one kilometer of a trackway), however, the provision of a multiple redundant securing System by the use of high quality and high dimensional stability bolts is not very economic. Besides, the number of fixing bolts because of a restricted place cannot be arbitrarily increased. Further, in view of a large number of fixing bolts required for each equipment element, it is practically not possible to conduct all necessary inspections for the fixing bolts of a trackway in short time distances.

The foregoing problem exists also in other known supporting structures (German Patents 3,111,385; 2,604,688) in which for securing an equipment element fixing bolts are used. With partial failure of these bolts, act on remaining bolts and, must absorb the forces which act during movement of a car along the supporting structure, in selected directions.

SUMMARY OF THE INVENTION

The object of the invention is a system for securing an equipment element to a support in which fixing bolts can be used which may not have a very high quality without increase of the number of fixing bolts and without adverse affect on the functional stability of the supporting structure.

The object of the invention is achieved by providing a securing system which comprises additional form-locking securing elements which become operational upon failure of the fixing bolts.

The advantage achieved by the present invention consists in that the supporting structure is provided not only with a redundant but also a diversified securing system for securing an equipment element to a support. In case of failure of the fixing bolts, the equipment element will be held in its position with the form-locking securing elements. This enables to sustain transporting function at least for a short time until the disturbance is noticed and removed. Advantageously, the form-locking securing elements are so formed and arranged that, during normal operation, they are not loaded, and therefore cannot be damaged. In preferred embodiments of the invention, the form-locking connection of the securing element is effected with a predetermined play. This provides for that, upon failure of a fixing element, a noticeable but acceptable displacement between adjacent ends of operational surfaces of adjacent equipment elements takes place. This displacement is noticeable and can be measured, for example, with distance sensors or the like with which each car may be equipped. Thereby it is possible to register an operational disturbance with a first car movable past the affected region, and the disturbance can be quickly eliminated.

The present invention both as to its construction so to its method of operation, together with additional objects and advantages thereof, will be best understood from the following detailed description of the specific embodiments when read in connection with the accompanying drawings.

DETAILED DESCRIPTION OF THE PREFERRED EMBODIMENTS

The supporting structure will now be described, by way of an example, as being used in a magnetic suspension railroad driven with a motor having an elongate stator. The supporting structure, however, with corresponding modification can also be used in other trackway transporting systems.

Figure 1:
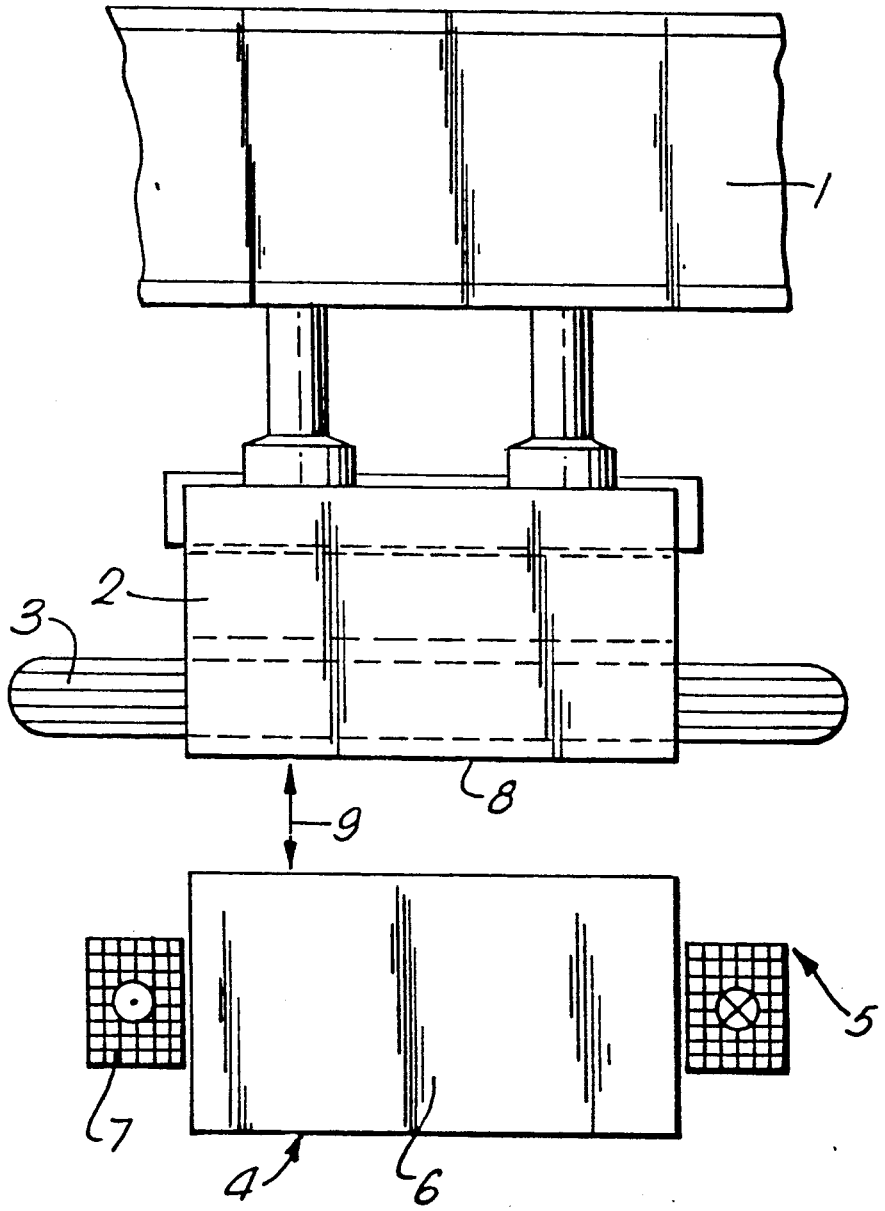
FIG. 1 shows a schematic view of a magnetic suspension railroad and its trackway.

A magnetic suspension railroad has a long-stator synchronous motor, shown in FIG. 1, generally has a trackway consisting of a plurality of component supporting structures arranged in the longitudinal direction of the trackway one after another and having a length, for example, of about 24 meters. Each supporting structure comprises at least one lateral support 1, which is supported with studs (not shown) that are fixed in a foundation. Each support includes generally a plurality of equipment elements 2, that, for example consist of a stack of sheets with screws and form the elongate stator of the motor and have a length, for example of 2 meters. In the grooves of the equipment elements 2, are located windings 3 through which a multiphase current having a variable amplitude and frequency, flows. The excitation of the elongate stator is provided by support magnets 4 which are connected to a vehicle 5 moved along the track and only schematically shown in FIG. 1. Each support magnet consists of a magnet core 6 an excitation winding 7. Further to the function of magnetically suspend the vehicle 5, the support magnets simultaneously provide the excitation field of the long-stator of the motor. Generally, the equipment elements are provided on both sides of the support 1 of the supporting structure, and the magnets 4 are arranged on both sides of the trackway.

The bottoms of all equipment elements 2 have operational surfaces 8 which should be spaced from trackway surfaces of the magnetic cores 6 in the suspended and moving condition of the vehicle 5, by a predetermined distance 9, for example, 10 mm. To this end the operational surfaces 8 should be arranged parallel to the theoretical line with small tolerances and should adjoin each other in the joint areas between the single equipment elements 2 with a small shift or displacement.

Supporting structures of the above described type are generally known (please refer, for example, to U.S. Pat. No. 4,698,895) and need not be described in more detail.

According to the invention, the support 1 shown in FIGS. 2 to 6 in steel version, is provided in its bottom side with connecting bodies 11 spaced in a longitudinal direction of the track and formed as web plates extending transverse to the track. The equipment elements 2 are secured to the connecting bodies with bolts 12. The connecting bodies 11 are provided with bosses 14 which extend toward the equipment elements 2, i.e. which project downward from the connecting bodies and transverse to the track direction in FIG. 2 and whose free end surfaces define first stop surfaces 15 (see FIGS. 2 and 6). Each boss 14 and a respective portion of a respective connecting body 11 have a bore 16 (FIG. 5) for receiving a respective connecting or fixing bolt 12. The bores 16 are preferably threaded bores in which the bolts 12 can be secured without use of nuts.

The equipment elements 2 are provided, on sides thereof adjacent connecting bodies 11, here on upper surfaces thereof, with crosspieces 17, the upper surfaces of which define second stop surfaces 18 (FIGS. 2 and 6) extending parallel to operational surfaces 8 of respective equipment elements 2. The crosspieces 17 are preferably fixedly connected with respective equipment elements 2, for example by means of form-locking groove-spring connection (groove/tongue joint) and additional glueing. Preferably the stop surfaces 18 are equidistantly spaced from the operational surfaces 8. The distance between the crosspieces 17 in the longitudinal direction of the track corresponds to that of connecting bodies 11 and bosses 14.

Figure 2:
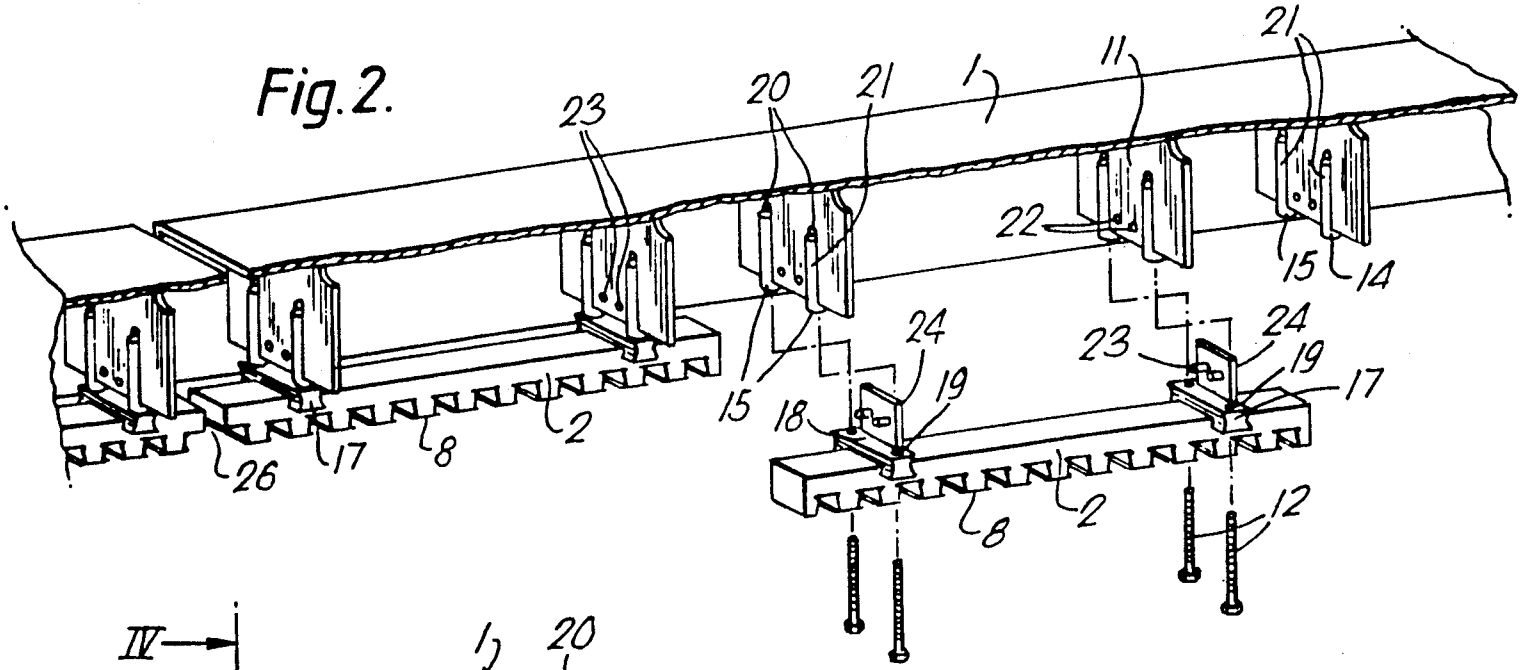
FIG. 2 shows a perspective and partially exploded view of a supporting structure in version with additional form-locking securing elements.
Figure 3:
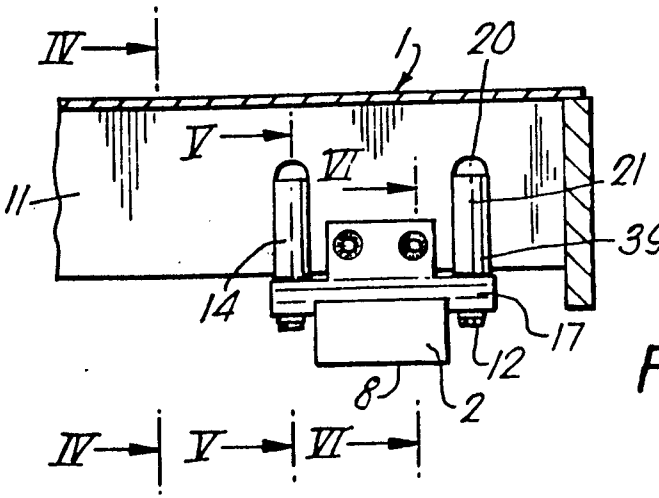
FIG. 3 shows a cross-sectional view along line III—III in FIG. 2.

The crosspieces 17 are provided at lateral ends thereof projecting beyond the equipment elements with bores 19 (FIG. 2) for receiving the bolts 12. Preferably each equipment element 2 (as shown in FIG. 2) is provided with two crosspieces 17 with each crosspiece having two openings 19. The distance between bores 19 in each crosspiece 17 corresponds to the distance between bolts 12 of a respective connecting body 11. Thereby each equipment element 2 is secured to corresponding support 1 with four bolts 12.

For mounting the equipment element 2, the stop surfaces 15 and 18 are brought against,each other, the bores 16 and 19 are aligned, and the bolts 12 are screwed in until their heads firmly abut the bottom surfaces of the crosspieces 17. The approximation of the equipment elements 2 to the bosses 14 can practically be done from any desired direction.

In order to insure that the operational surfaces 8 of all equipment elements of any supporting structure, after mounting, automatically are arranged, within permissible tolerances, in positions along the track according to selected portions of a given line, all equipment elements 2 are formed substantially identical, whereas the corresponding first stop surfaces 15 and bores 16 are formed in accordance with the line, i.e. such that they meet the prescriptions of the line. This means in the embodiment as shown in FIGS. 2–6 that all stop surfaces 15 of any supporting structure are arranged on a surface that has the same course as the portion of the line which is assigned to this particular supporting structure. Hence, after securing all equipment elements 2 to this particular supporting structure, also the surface formed of the respective operational surfaces 8, has a course corresponding to the respective line portion. Finally, the relative position of bosses 14 on each support is so selected that after aligning the whole support one after another in the correct sequence or order along the trackway and after securing the supports, the operational surfaces 8 of all equipment elements 2 lie on a surface prescribed by the line, and no displacement, except for the permissible tolerances, in any direction in joint areas of single equipment elements or support is present. Insofar, the displacement should be small with lateral displacement (normally at most a few millimeters) and even smaller with displacement in height.

Actually, the operational surfaces 8 of single equipment elements 2 and also the stop surfaces 15 and 18 associated therewith lie preferably in planes such that the total operational surface of each supporting structure forms a polygonal course defined by a plurality of plane operational surfaces 8. The deviation of actual values from a set value caused thereby is acceptable in view of the large radii of curvature of the conventional tracks. The stop surfaces 15 corresponding to an equipment element 2 may lie as in the same plane so in a different plane. In the latter case, the stop surfaces 18 should also lie in corresponding different planes.

Forming the first stop surface 15 serving as a reference surface, for positioning of the operational surface, is effected as follows. At the end of a manufacturing process, the support 1 is provided with connecting bodies 11 having bosses 14. The bosses 14 have a length which is greater than the maximum required length of a boss 14 inside the trackway. Then, the bosses 14 are, preferably similarly to a known method (see U.S. Pat. No. 4,698,895), processed in a subsequent working operation with a computer-controlled tool. The advantage of this consists in that the known method and the apparatus for carrying it out need only small modification comprising providing an additional tool in the form of an end milling cutter or the like that machines each single boss 14 to a required length so that a stop surface obtained as a result, provides a fixed reference plane for the required angular position with respect to a stationary coordinate system. By using a combined spotfacing drill-end milling cutter tool or the like can, during the same working operation, the bores 16 be formed with axes extending perpendicular to the stop surface 15, and which bores can-be provided with a thread. These working steps can be performed one after another or, at least partially, simultaneously and, preferably, in a climate-controlled environment under controlled conditions and with taking care of all parameters which are important for the line (see U.S. Pat. No. 4,698,895). The securing of equipment elements 2 can alternatively be conducted at the factory or at the construction site, as necessary, after mounting of the support because adjustment is not required.

The bosses 14 can be formed directly on the connecting bodies 11 or, alternatively, as shown in FIGS. 2–6, the connecting body can be provided with bores, depressions or recesses 20 in which rods 21 can be secured, for example by welding. The length of a rod 21 is so selected that their free ends project from bores 20 and, similar to bosses 14, end surfaces of these free ends define first stop surfaces 15. The bores 16 in this case are preferably formed in rods 21.

When four bolts 12 are used for each equipment element 2, additional securing means is not provided and the system is redundant. Even if any bolt 12 fails, no functional disturbance occurs. The same is true when one bolt fails in each crosspiece 17. If both bolts 12 at the same end of a crosspiece 17 fail, then the equipment element 2, because of its own rather substantial weight will fall or, due to forces generated by moving the vehicle 5 along the trackway, will be displaced in the acting direction of these forces. As a result, both the bolts 12 may break or become bent. In each case, in a joint area adjacent to an effective equipment element 2, a functional disturbance, in a form of a large displacement between adjacent operational surfaces 8, occurs.

To avoid this unacceptable, inappropriate function, according the invention there is provided a redundant and diversified securing system comprising, in addition to fixing bolt 12, form-locking securing elements which, upon failure of fixing bolts, become operational and limit falling out of the equipment elements.

The further securing elements preferably extend transverse to the fixing bolts 12. They consist, as shown in the embodiment of FIGS. 2–6 of two openings 22 provided in the connecting body 11 with axes extending parallel to the stop surface 15, and of two safety elements 23 connected to equipment element 2 preferably to its crosspieces 17 and received in openings 22. Thus, the two openings 22 and securing elements 23 act in pairs.

Figure 4:
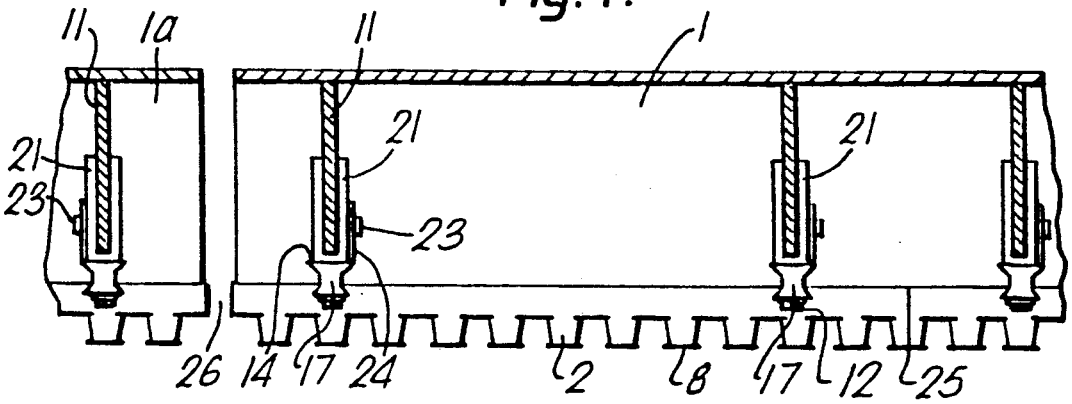
FIGS. 4 and 4*a* show, respectively, cross-sectional views along line IV—IV in FIG. 3 in two different operational conditions.

According to this embodiment, the safety elements 23 are fixed in bores of stays 24 preferably by welding, so that they are, in a direction transverse to stop surfaces 18, additionally held by a form-locking connection. The stays 24 are formed integral with crosspieces 17 (FIG. 6) or are connected therewith in some other way. The axes of the bolt-like safety elements 23 extend parallel to the stop surfaces 18 and longitudinal axes of the equipment elements 2, wherein the distance between them corresponds to the distance between corresponding openings 22. The axes of the openings 22 extend parallel to the longitudinal direction of supports 11 or transverse to the direction of operational forces, and their distance from stop surfaces 15 generally corresponds to the distance of safety elements 23 from the stop surfaces 18. Thus, for example, the equipment elements 2 of a support 1 shown at the right side of FIG. 4 may be mounted as follows. The safety elements 23 associated therewith are inserted in the openings 22 by displacing the equipment elements from right to left. Then, the fixing bolts 12 are secured on appropriate bores. Then the next following equipment elements may successively be mounted by advancing from left to right and by providing joint areas 25 (see FIG. 4). Also, the mounting of the equipment elements can be effected in opposite direction as shown in FIG. 4 for the embodiment shown at the left side. In assembled condition the stays 24 limit undesirable displacement of the equipment element 2 in either direction.

Figure 4A:
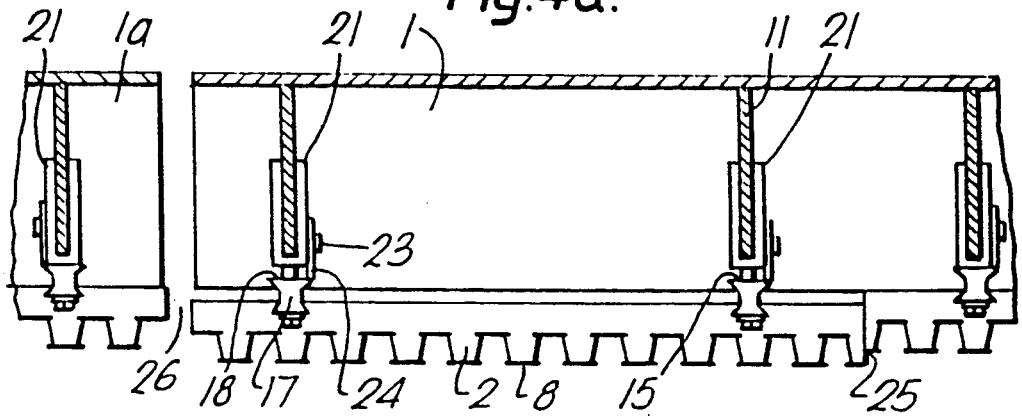
Figure 5:
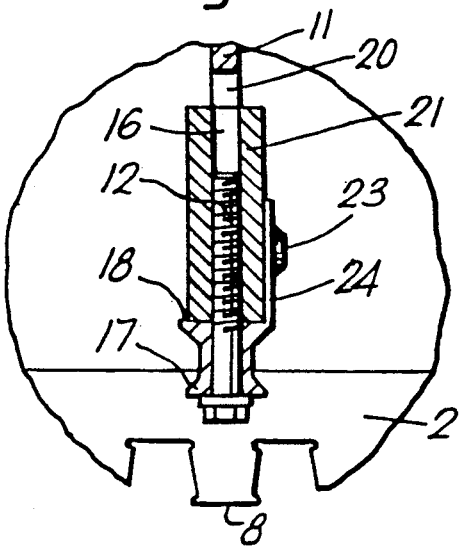
FIG. 5 shows an enlarged cross-sectional view along line V—V in FIG. 3.
Figure 6:
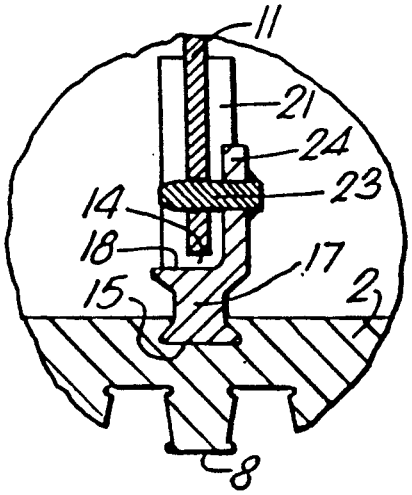
FIG. 6 shows an enlarged cross-sectional view along line VI—VI in FIG. 3.

The cross-section of the opening 22 is preferably somewhat bigger than the cross-section of the securing element 23 whereby the form-locking connection is effected with a Predetermined play in the direction of action of operational forces. This, on the one hand facilitates mounting of the equipment element 2 and enables, on the other hand, upon failure of both fixing bolts 12, displacement of the crosspiece 17 or the equipment elements 2 a predetermined amount, for example, maximum 2–3 mm. FIG. 4*a* shows a condition in which all four fixing bolts 12 of a equipment element has failed. As a result, in the joint area 25 of an adjacent equipment element 2 of the same support 1 or in a joint area 26 of an adjacent equipment element 2 of a neighboring support 1 a displacement takes place which is noticeable from outside and can be sensed by an appropriate means. For example, the double failure of fixing bolts can be sensed, during movement of a car, by sensors with which each car of the system is equipped, and the disturbance can be quickly repaired.

The safety elements 23 are so formed, that they, on all equipment elements 2, are allocated in the same place and have the same shape and size. The openings 22 are formed with, preferably, a computer-controlled tool, for example a drill, during forming the bores 16 and stop surfaces 15 and in accordance with the line. This ensures that the axes of the openings 22 extend parallel to the stop surfaces 15 and that the axes are spaced from the stop surfaces 15 by a distance corresponding to the spacing of the axes of the safety elements 23 from the second stop surfaces 18. This can be effected in a simple manner by providing a known apparatus (see U.S. Pat. No. 4,698,895) with an additional tool and during forming the openings 22 of a connecting body 21 during a subsequent operation, using the stop surface 15 of these connecting bodies as a reference for control coordinates of a respective tool.

Figure 7:
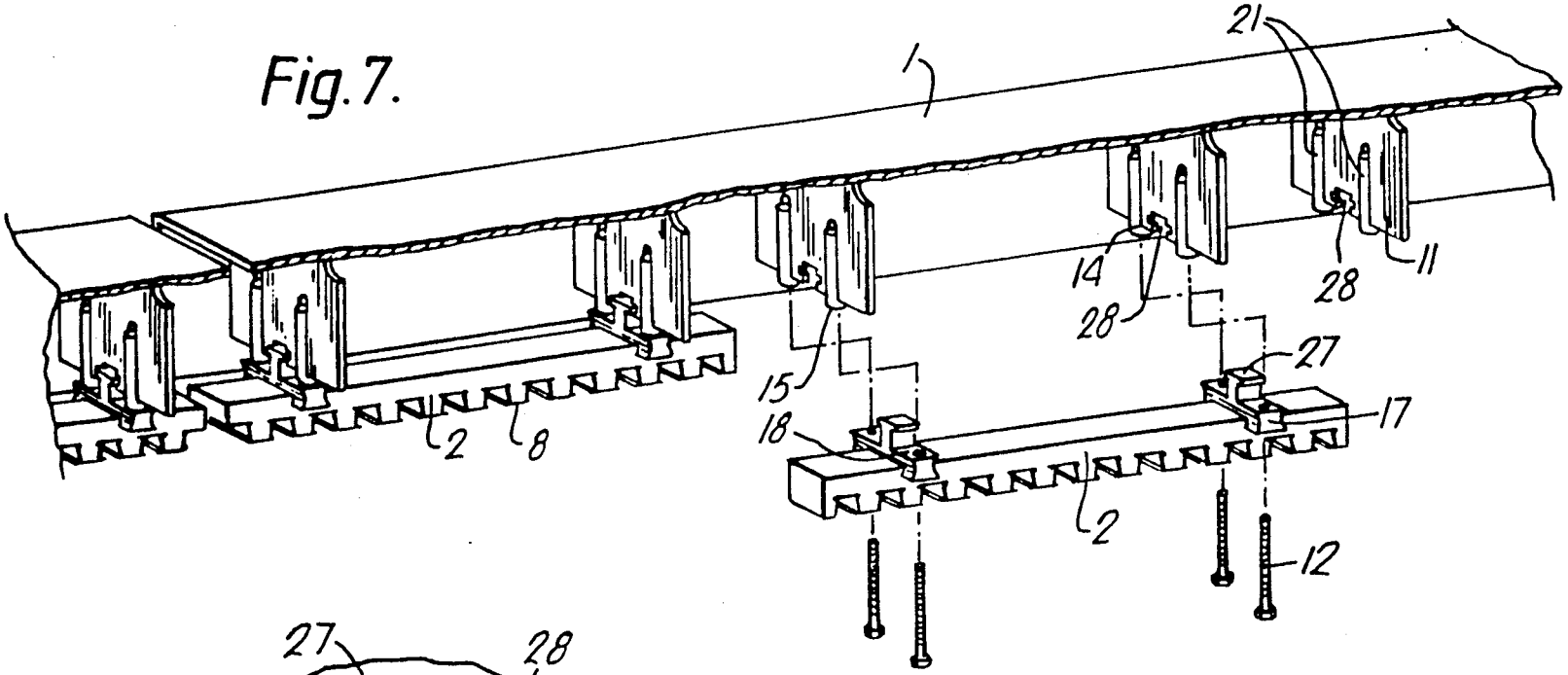
FIG. 7 shows a view similar to that of FIG. 2 of another embodiment of the supporting structure according to the invention with form-locking securing elements
Figure 8:
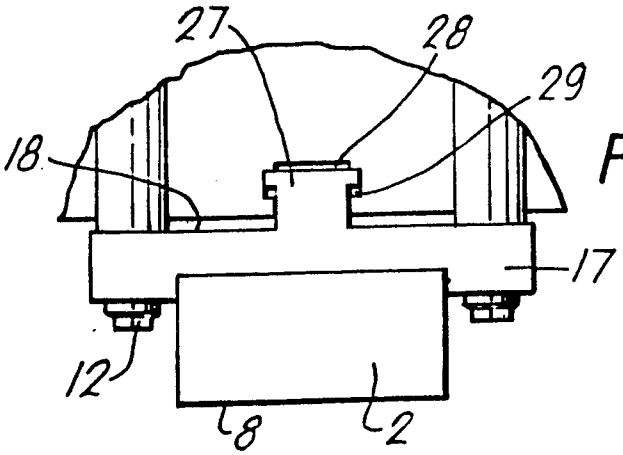
FIG. 8 shows an enlarged view of a securing element shown in FIG. 7.

A further embodiment of the securing system is shown in FIGS. 7 and 8 in which the identical parts are designated with the same reference numerals. Instead of bolt-like safety elements, in this embodiment, there are provided on the outer surfaces of crosspieces 17 bar-like safety elements 27 having a T-shaped cross-section which are received in corresponding T-shaped openings formed in the connecting bodies 11. Reference numeral 29 shows a play in the embodiment shown in FIG. 8. The play enables an easy connection. The openings 28 are generally formed with computer-controlled tool in accordance with the line course.

Figure 9:
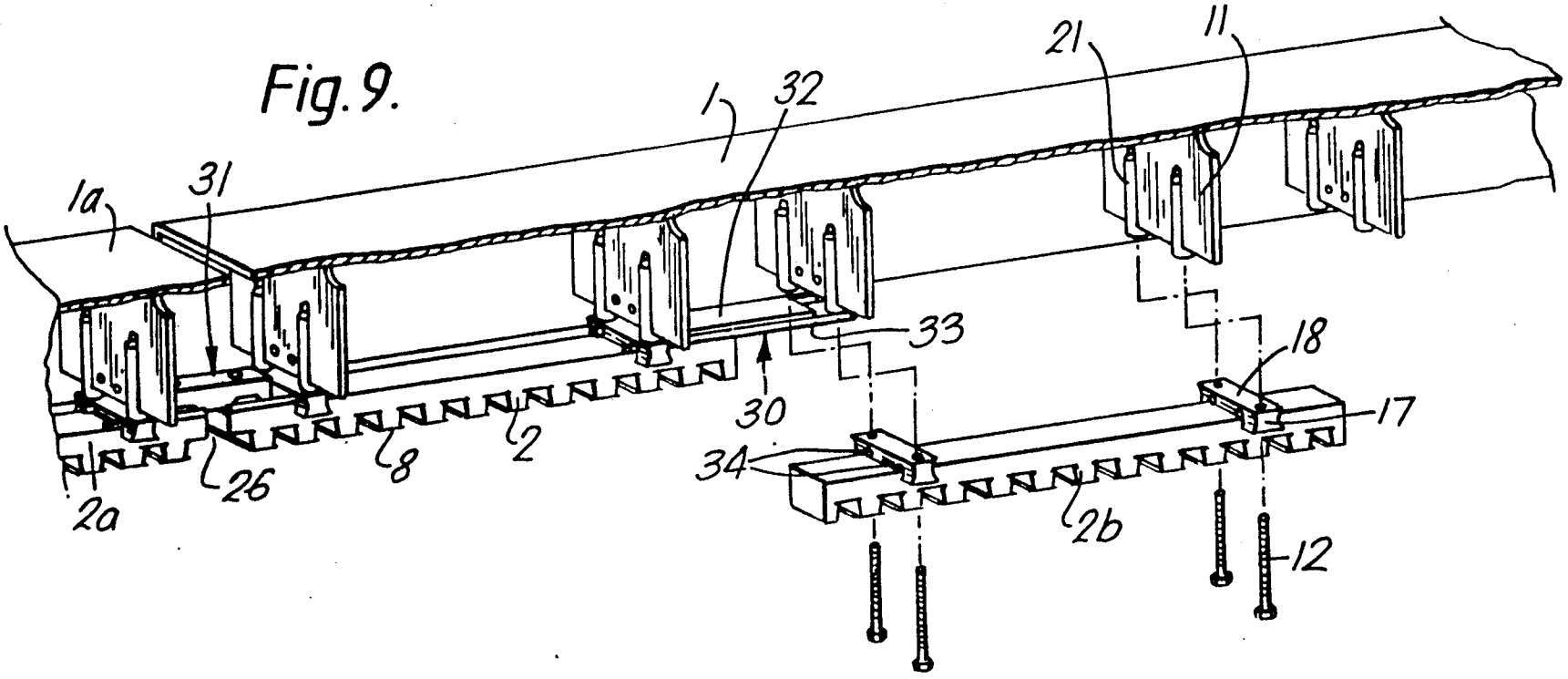
FIG. 9 shows a view similar to that of FIG. 2 of yet another embodiment of the supporting structure according to the invention with two further embodiments of form-locking securing elements.
Figure 10:
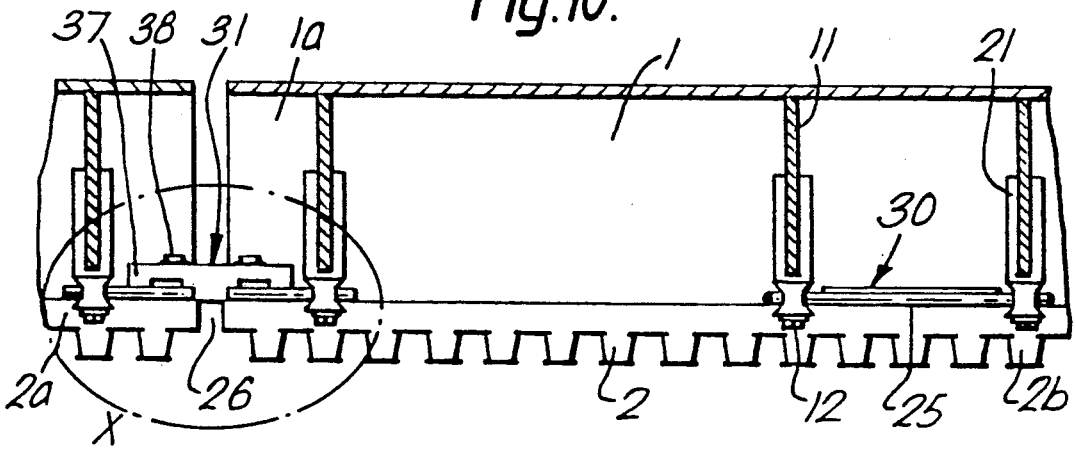
FIG. 10 shows a cross-sectional view similar to that of FIG. 4 of a supporting structure shown in FIG. 9.

FIGS. 9–12 show two further embodiments of the securing system according to the invention. The securing system shown in FIGS. 9–12 differs from that shown in FIGS. 2–8, in that one of the respective form-locking securing element is not connected to the support 1 but is arranged in the joint area 25 or 26 and designed as a safety element 30 or 31 which bridges the joint area 25 or 26. A safety element 30, preferably formed of one member or an integral member (FIGS. 10 and 12), serves for bridging the joint area 25 between two equipment elements 2 and **2*b* secured on the same support 1. The safety element 30 comprises a plate-like portion 32 to which are secured two pairs of opposite extending arms 33 parallel to each other. Further, the crosspiece 17 (FIG. 9) includes, in addition to bores 19, further bores 34 having axes extending parallel to the stop surface 18 and longitudinal direction of the equipment element 2. At mounting of the equipment element 2, the arms 33 are received in respective bores 34. At that, the Plate-like portion 32 is so formed that it engages the upper surface of the equipment element 2 as shown in FIG. 10 so that the falling equipment element 2 or 2*b* is prevented even when both respective fixing bolts 12 fail. The mounting of the equipment elements of a support is made the same as for the other embodiment. In this case, it is also possible to provide a connection with a predetermined play so that the double failure of bolts is visible and measurable. In this case, the portion 32**, during normal operation must not engage the equipment element.

Figure 11:
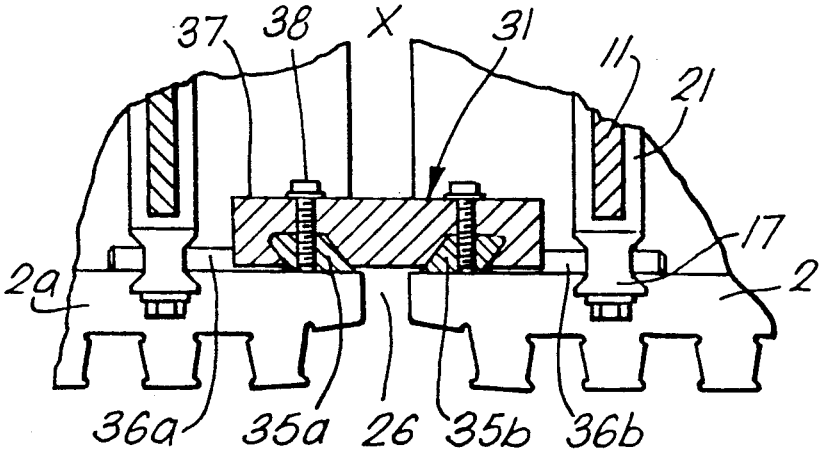
FIG. 11 shows an enlarged partial cross-sectional view of a portion of a supporting structure shown in FIG. 10.
Figure 12:
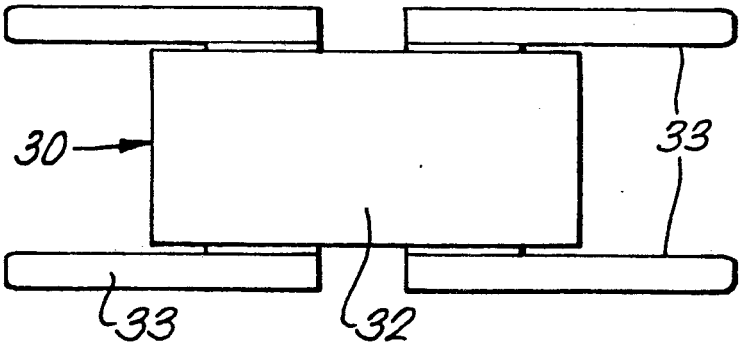
FIG. 12 shows an enlarged view of one of two form-locking securing elements shown in FIG. 10.

The safety element 31 shown in FIGS. 10 and 11 is a multipart element because it bridges the joint area 26 between two equipment elements 2 and **2*a* attached to two different supports 1 and 1*a*. The safety element 30 shown in FIG. 11, can not be used for bridging the joint area 26 because the equipment elements 2*a*, 2 as a rule, are secured to respective supports 1*a* and 1 before installation of the supporting structure and the supports 1*a* and 1 are mounted one after another. As especially shown in FIG. 11, the safety element 31 comprises two bar-like portions 35*a* and 35*b* provided with respective arms 36*a* and 36*b* corresponding to arms 33 of the safety element 30 and matching the bores 34 of the crosspiece 17 (FIG. 9). The safety element 31 further includes a connecting member 37 having two openings or recesses for receiving portions 35*a* and 35*b* and two bolts 38 for securing the portions 35*a* and 35*b* in respective openings. Thus, the fixing element 31 is somewhat similar to the safety element 30 but includes additional securing means such that it can be mounted after the equipment elements 2*a*, 2 have been mounted on the respective supports 1*a* and 1. The connecting element 37 may be put onto the portions 35*a* and 35*b*** from above or from the side. Here also the connection can be provided with a limited play if needed.

Because the securing elements 30, 31 extend only between to equipment elements 2, **2*a* and 2*b* and are not connected with respective supports 1 and 1*b*, the bores 34 need not be formed in accordance with the line course. It is enough that all equipment elements 2, 2*a* and 2*b*** have these bores in the same place which provides for simple manufacturing.

Figure 13:
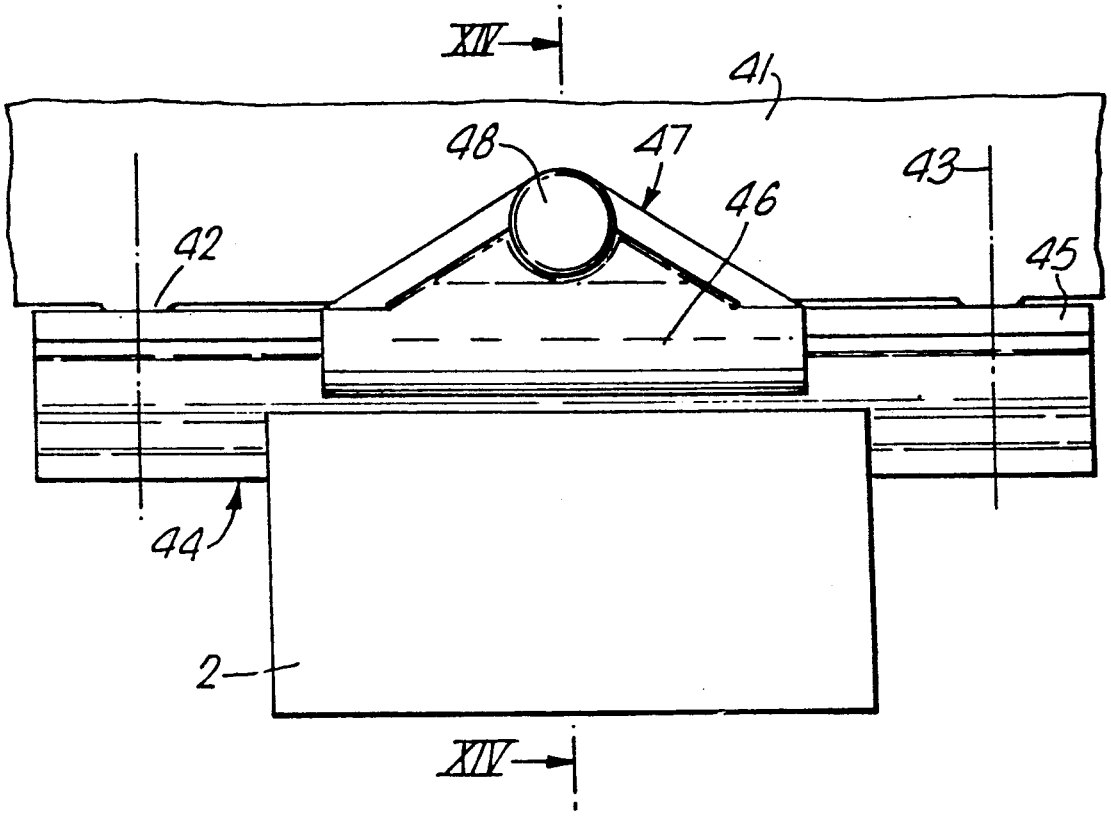
FIG. 13 shows a view similar to that of FIG. 3 of still another embodiment of a supporting structure according to the invention.
Figure 14:
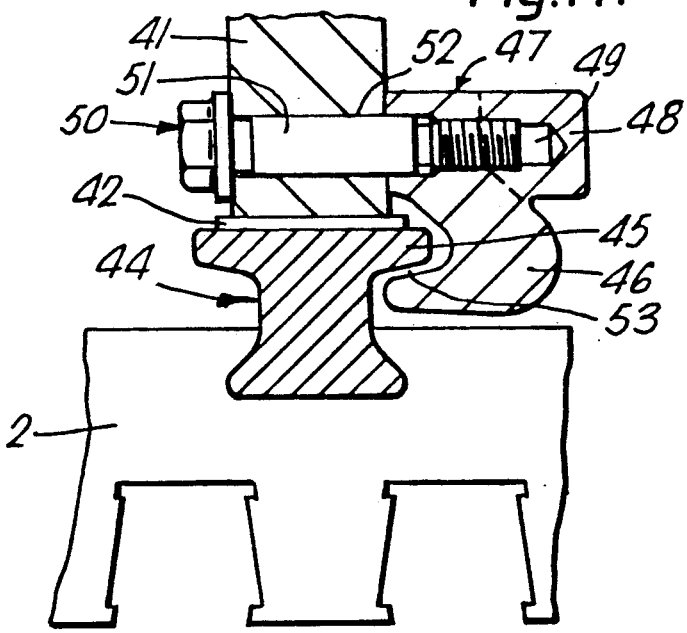
FIG. 14 shows a cross-sectional view along the line XIV—XIV in FIG. 13.

The embodiment of the securing system shown in FIGS. 13 and 14 differs from those shown in FIGS. 2–12 in that the bosses 42 are formed directly on the connecting body 41. Generally, the bosses 42 in their shape, function and manufacturing process correspond to the bosses 14. The openings in bosses 42 corresponding to respective opening 16 are shown with dash line 43.

On the upper surfaces of equipment elements 2, there are provided crosspieces 44 which generally are similar to crosspieces 17. The upper surface of each crosspiece 44 is provided with at least one flange-like stop web 45 which projects from the crosspiece 44 to the side. The stop web 45 is engaged by a safety element 46 formed as a hook projecting from a hook-type plate 47 which, as shown in FIG. 13 is deformed to define a projection 48. This projection 48 engages a side surface of the connecting body 41 and is provided with a thread bore 49 for receiving a bolt 50 having a threadless portion 51 extending through a bore 52 of the connecting body 41 and engaging with its head the opposite side surface of the plate-like connecting body 41. The bore 52 or several such bores are formed in accordance with the track course as it was described above in connection with forming openings 22. The bore 52 and the threadless portion 51 of the bolt 50 may have substantially the same diameter.

The stop web 45 and the safety element 46 form a form-locking connection that connects the crosspiece 44 and the respective equipment element 2 when fixing bolts fail in order to retain the equipment element in its position. As a rule, there is provided two hook-type plates 47 for each equipment element 2, because the equipment elements 2 are separated by small joints. Alternatively, a hook-type plate 47 can be provided at both sides of the connecting body 41 for engaging stop webs 45 formed at opposite sides of the crosspiece 44.

It is also desirable to provide a play in the embodiment of FIGS. 13 and 14. Such a play is shown with reference 53 in FIG. 14.

Figure 15:
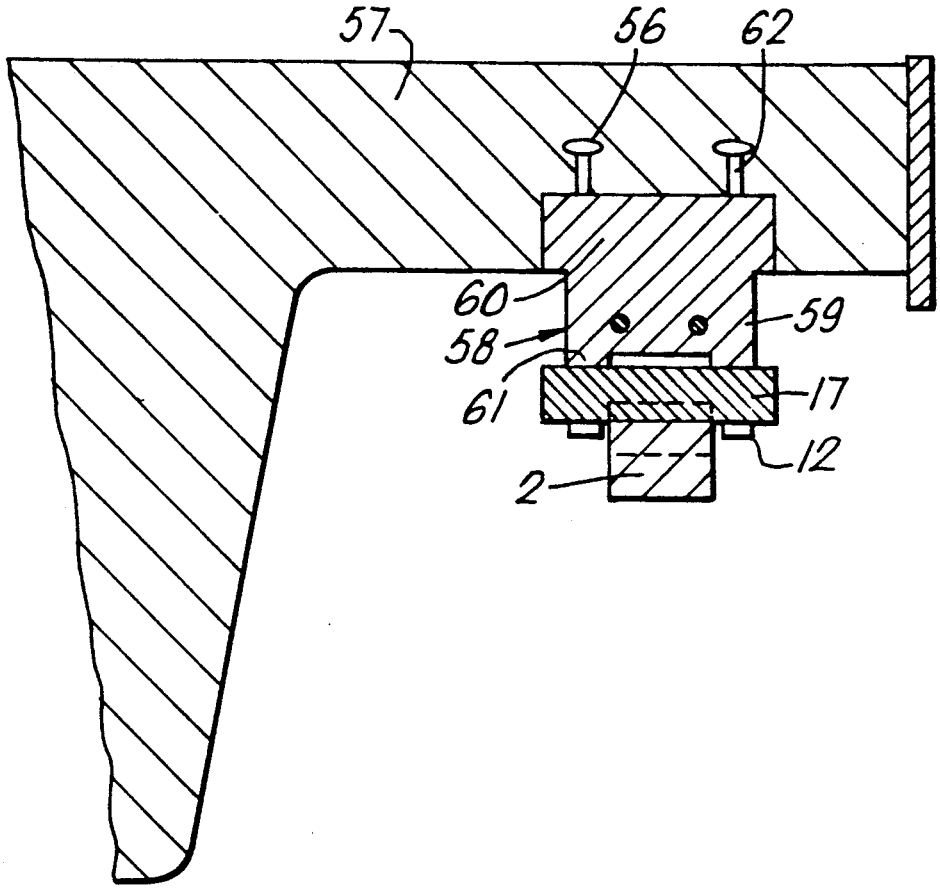
FIG. 15 shows a transverse cross-sectional view of a supporting structure according to the invention in a cement version.
Figure 16:
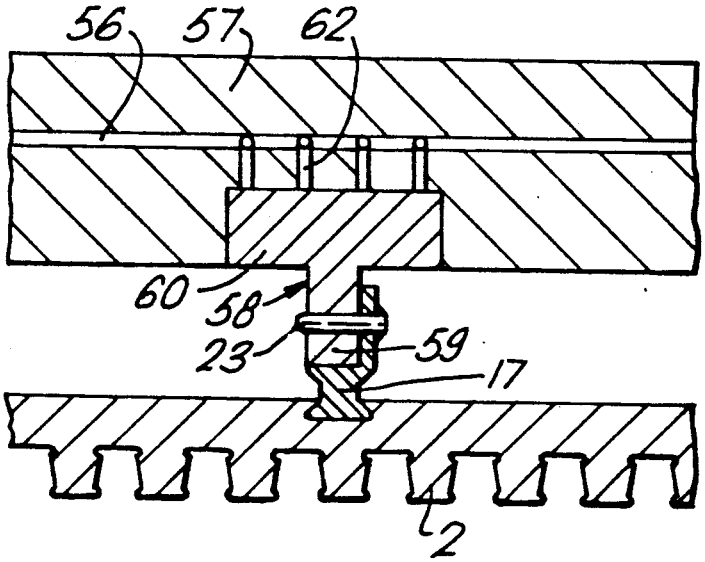
FIG. 16 shows a longitudinal cross-sectional view if a supporting structure according to the invention in a cement version.

The embodiment of FIGS. 13 and 14 has two significant advantages. One advantage consists in that the stop web 45 and the safety element 46 extend practically through the whole width of the equipment element 2 or the crosspiece 44 and can be so formed and arranged that, upon failure of the fixing bolt, they provide a large surface contact whereas, in the embodiment of FIG. 2–6 and 9–12, only linear contact is provided. The other advantage consists in that the hook-type plates 47 can be mounted after mounting cf all equipment elements 2. Thereby it is possible to mount and dismount the equipment elements 2 in arbitrary order by mounting or dismounting them in a direction transverse to the track. In a cement version, supports with cement reinforcement can have at the bottom side as shown in FIGS. 15 and 16 connecting bodies 58 which are spaced in the longitudinal direction of the track. These bodies 58 are preferably made of steel in a form of web plate extending transverse to the track. The connecting bodies 58 have flange-like mounting plates 60 at one end thereof and bosses 61 defining first stop surfaces and corresponding to bosses 14 and 22, at the other end thereof. The equipment elements 2 are attached to bosses 61 with fixing bolts 12. In contrast to the steel version of FIGS. 1–14, the mounting plates 58 during forming of supports 57 are embedded in cement and, as shown by reference numeral 62 in FIGS. 15 and 16, are preferably fixedly connected to the reinforcement 56. In all other respects the arrangement of FIGS. 15 and 16 correspond to that of FIG. 1 to 6 or alternatively, to that of FIGS. 7–14.

As particularly shown in FIG. 15, the mounting plate 58 is embedded in the cement, preferably in such a manner that its bottom surfaces is flush with the bottom surface of the support 57. In such a case the intermediate portion 59 of the connecting body can be made very short or even completely eliminated and bosses 61 can be formed directly on the mounting plate 60. In the latter case, a very compact and mechanically stable structure is obtained. If need be the support 57 in the region of bosses 61 can be provided with recesses that facilitate positioning of the tool for forming the bosses 61.

The invention is not limited by the described embodiments, and various modifications can be made therein. For example, it is not necessary that bores 16 for receiving bolts 12 are formed in bosses 14 or rods 21. They can be formed in a region of connecting body 11 and equipment element 2 extending out beyond the stop surfaces 15 or 18. It is further possible to use more or less than four bolts 12 or more than two crosspieces 17 for mounting the equipment element 2. Also, the number of equipment elements 2 per each support may vary. In addition to equipment elements 2 other equipment elements, for example, lateral guide rails 39 shown for example in FIG. 3 can be attached to the supporting structure. Further, the invention is not limited by using form-locking securing elements that extend in the longitudinal direction of the track way. In a modification of embodiments shown in FIGS. 2–12 it is also possible, for example for the safety element to extend in the direction transverse to the longitudinal direction of the trackway and transverse to the axes of fixing bolts 12. The above-mentioned solution has an advantage that, with using safety elements 31 in combination with safety elements 23, 27, or 30 an additional security is provided. In This case, even upon failure of the fixing bolts 12, the securing elements can not be released from respective openings. Further, longitudinal displacements of the equipment elements are practically impossible because the equipment elements 2 join each other within each support 1, and because displacements between two supports 1 and 1*a* are prevented with the securing elements 31.

The operational direction of the form-locking safety element and also the direction of movement during assembling the parts, naturally, depends on the direction in which the fixing bolts are loaded either permanently or, at least, during movement of a car, that is during normal operation of the supporting structure.

Also, the shape and the position of the stop surfaces 15 and 18 can be optionally selected inasmuch as they correspond to the required position of the equipment element 2 on the support 1. Further, the securing system according to the invention has an advantage that all parts thereof can be simply manufactured and mounted. The stop surfaces 15 and 18 enable the equipment element to be approximated to the support 1 or the connecting body 11 from a plurality of directions so that also the joining direction for the safety elements of the securing system can be selected in a great variety. Further, the securing system according to the invention makes possible a simple registration of failures of the fixing bolts by using safety elements which, at least partially, are provided with predetermined resiliency instead of a selected play. For example, the securing elements 23, 27, or arms 33, or hook-type plates 47 can have a resilience such that during loading, for example during movement of cars, a definite displacement between adjacent operational surfaces 8 can be registered.

Generally it is not intended that the invention be limited to the details shown, since various modifications and structural changes may be made without departing in any way from the spirit and scope of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A structure for supporting a trackway of a track following transportation system, said supporting structure comprising at least one support; at least one equipment element having an operational surface; fixing bolt means securing said equipment element to said support in a predetermined position and in such a way that failure of said fixing bolt means causes displacement of said equipment relative to said support; and form-locking means for acting on said equipment element but becoming effective only in case of said failure for then limiting said displacement of said equipment element to a predetermined amount which makes possible to notice said failure.

2. A supporting structure as set forth in claim 1, wherein said form-locking means includes opening means provided in said support and a safety element means provided on said equipment element.

3. A supporting structure as set forth in claim 2, wherein said support includes a connecting body, said opening means being provided in said connecting body.

4. A supporting structure as set forth in claim 2, wherein said opening means has the cross-section which is greater than a cross-section of said safety element means.

5. A supporting structure according to claim 1, wherein said form-locking means includes opening means provided in said equipment element and safety element means received in said opening means and bridging a joint area between adjacent equipment elements.

6. A supporting structure as set forth in claim 5, wherein said safety element comprises a plate-like securing element.

7. A supporting structure as set forth in claim 5, wherein said opening means has a cross-section which is greater than a cross-section of said safety element means.

8. A supporting structure as set forth in claim 1, wherein said form-locking means includes a step web provided on said equipment element and a safety element provided on said support.

9. A supporting structure as set forth in claim 8, wherein said support is provided with a connecting body, said safety element being attached to said connecting body.

10. A supporting structure as set forth in claim 8, wherein said stop web and said safety element are spaced a predetermined amount.

11. A supporting structure as set forth in claim 1, wherein said equipment element is provided with a crosspiece having at least one of the means of a group comprising bore means for receiving said fixing bolt means, stop surface means serving to correctly position said equipment element on said support, and at least one of said form-locking means.

12. A supporting structure as set forth in claim 1, wherein said support includes a connecting body having opening means for receiving said bolt fixing means, boss means formed on said connecting body and extending toward said equipment element, said first stop surface means provided on said boss means, wherein said equipment element is provided with second stop surface means for abutting said first stop surface means when said equipment element is secured with said bolt fixing means to said connecting body, and wherein said first stop surface means are arranged and designed in dependence from a given line for the trackway such that the operational surface substantially has a same course as a selected portion of the line when said second stop surface means abuts said first surface means and when said equipment element is secured to said connecting body.

13. A supporting structure as set forth in claim 12, wherein said opening means is provided in said connecting body.

14. A supporting structure as set forth in claim 12, wherein said safety element is attached to said connecting body.

15. A supporting structure as set forth in claim 1, wherein without said failure of said bolt fixing means said form-locking means is adapted to be unloaded.

16. A supporting structure as set forth in claim 1, wherein said form-locking means has a predetermined play.

17. A supporting structure as set forth in claim 1, wherein said form-locking means has a predetermined resilience.

* * * * *